United States Patent [19]

Evezich

[11] Patent Number: 4,469,250

[45] Date of Patent: Sep. 4, 1984

[54] SQUEEZABLE DISPENSING APPARATUS AND METHOD OF OPERATION

[75] Inventor: Paul D. Evezich, Evanston, Colo.

[73] Assignee: Nick Sekich, Jr., Longmont, Colo.

[21] Appl. No.: 352,445

[22] Filed: Feb. 25, 1982

[51] Int. Cl.[3] ..... B65D 35/28

[52] U.S. Cl. ..... 222/83.5; 222/95

[58] Field of Search ..... 222/94, 386.5, 81, 83, 222/83.5, 212, 209, 214, 95

[56] References Cited

U.S. PATENT DOCUMENTS

| | | | |
|---|---|---|---|
| 3,203,592 | 8/1965 | Farandatos . | |
| 3,225,967 | 12/1965 | Heimgartner . | |
| 3,255,923 | 6/1966 | Soto . | |
| 3,270,920 | 9/1966 | Nessler . | |
| 3,592,365 | 7/1971 | Schwartzman | 222/209 |
| 3,603,484 | 9/1971 | Ogle . | |
| 3,731,844 | 5/1973 | Baker | 222/83 |
| 3,995,772 | 12/1976 | Liautaud | 222/83.5 |

*Primary Examiner*—Stanley H. Tollberg
*Attorney, Agent, or Firm*—O'Rourke & Harris

[57] ABSTRACT

Apparatus for dispensing flowable, usually fluid, material contained in a bladder, the apparatus comprising an exterior resilient container adapted to receive and secure the bladder, the exterior container including a first one-way check valve communicating with the interior of the bladder and positioned to permit flow of the contents of the bladder to the exterior of the apparatus, and a second one-way check valve positioned to permit air to flow between the container and bladder. Preferably, the container includes a cap portion removable from the body portion of the container proper, and comprising a probe adapted to pierce and seal with the bladder when the cap portion of the container is secured to the body portion with the bladder disposed for engagement of and securing by annular surfaces defined on the body portion and the cap portion.

5 Claims, 4 Drawing Figures

SQUEEZABLE DISPENSING APPARATUS AND METHOD OF OPERATION

DESCRIPTION OF THE RELATED ART

Numerous storage, transportation and/or dispensing devices utilizing bladder containment and/or pressure dispensing are known. For instance, U.S. Pat. No. 3,255,923 issued June 14, 1966 to R. H. Soto describes a bladder like pouch for storing and disposing liquid contents. While the bladder provides for economical and effective protection of a contents, the structure is largely without a self-supporting form, and serves primarily as a convenient, disposable container.

U.S. Pat. No. 3,225,967 issued Dec. 28, 1965 to J. Heimgartner and U.S. Pat. No. 3,270,920 issued Sept. 6, 1966 to C. G. Nessler disclose arrangements in which an internal bladder is acted upon by either an internal gas supply, or an external gas supply, to urge the contents of the bladder from the container. In both cases, a valve means is required to modulate the expulsion of the contents from the bladder.

Various other arrangements, such as U.S. Pat. No. 3,203,592 issued Aug. 31, 1965 to D. Farandatos and U.S. Pat. No. 3,603,484, issued Sept. 7, 1971 to Robert W. Ogle, disclose arrangements for dispensing and/or internally mixing components for dispensing by perforating internal container with a projection positioned on the external container.

However, in none of the prior art arrangements is a convenient, sealed, squeezable container provided to afford a free standing structure while maintaining the economy and convenience of bladder transportation and storage.

SUMMARY OF THE INVENTION

The present invention, which provides a heretofore unavailable improvement over previous storage and dispensing apparatus' for use with flowable materials, concerns a squeezable structure in the form of a resilient, preferably two part outer container adapted to receive and position an internal bladder structure with the bladder communicating with the exterior of the structure through a one-way check valve at one position, and with a second one-way check valve disposed to permit air to flow between the bladder and interior surface of the container. In a preferred embodiment, the bladder structure is initially sealed, but may be placed within the resilient deformable container, and, when the two parts of the container are secured together, pierced by a portion of the container adjacent the first check valve and secured between opposed annular surfaces defined on the components of the two part container.

Accordingly, an object of the present invention is to provide a new and improved method and apparatus for conveniently and effectively securing a bladder structure containing a fluid material to be dispensed.

Another object of the present invention is to provide a new and improved method and structure for dispensing fluid matter from a bladder container in which the contents of the container are substantially protected from the atmosphere while readily available for dispensing.

Yet another object of the present invention is to provide a new and improved method and structure in which an attractive, readily utilized outer resilient container may be reused to dispense fluid contents from an economical, disposable and conveniently used interior bladder storage portion.

These and other objects and features of the present invention will become apparent from the following description.

DETAILED DESCRIPTION OF THE DRAWINGS

Figure 1:
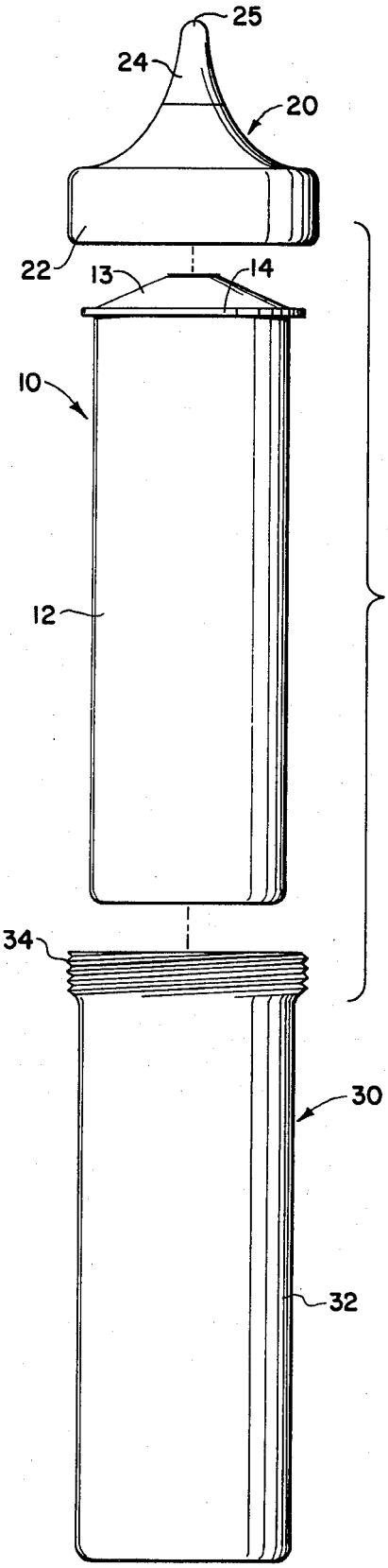
FIG. 1 is an axially exploded view of a storage and dispensing structure in accord with the instant invention particularly illustrating the two component external container relative to the internal bladder.

Turning now to the drawings, wherein like components are designated by like reference numerals throughout the various figures, a storage and dispensing structure in accord with the instant invention is illustrated in FIG. 1 as comprising a bladder insert, generally designated by reference numeral 10, a cap portion generally designated by reference numeral 20, and a body portion generally designated by reference numeral 30. As illustrated, bladder insert 10 is formed of a pliable, impervious material, such as a polymer film material and adapted to contain fluid contents such as liquids or flowable, powdered solids.

At a portion of the more rigid curved upper surface 13, of bladder insert 10, rigid annular ridge 14 provides further structural strength and a means of positioning as will be described in more detail below. Cap portion 20 is preferably formed with a threaded base 22 and a valve insert 24, which may be of a different material, than base 22 having defined therein a one-way check valve 25, as illustrated in the preferred form of a flapper valve. Other check valves such as spring loaded balls or gates will be operable but usually more expensive.

Body portion 30 comprises a substantially resilient, preferable polymeric main body portion 32 having at the upper portion thereof external threads 34. As shown in more detail in FIG. 2, bladder body 12 is secured within body portion 32 such that deforming body portion 32 inward as by squeezing will cause the contents of bladder body 12 to be expelled through outlet channel 26 under sufficient pressure to open one-way valve 25. Conical insert 28, defined at the terminus of outlet channel 26 opposite valve 25 extends through and is in sealing engagement with opening 16 defined in the upper portion of bladder body 12. A second one-way check valve 36 in the form of a flapper valve is defined through body portion 32 to permit air to relieve the lowered pressure generated after contents are expelled from bladder body 12 and resilient body portion 32 is allowed to resume its original shape. Flapper valves which preferably are utilized as one-way check valves 25 and 36 are essentially in the form of two surfaces which are nominally biassed together but distendable upon a pressure difference in a given direction, to permit flow, but which are urged together more tightly in the event of a pressure difference in the opposite direction, which enhances sealing.

Figure 3:
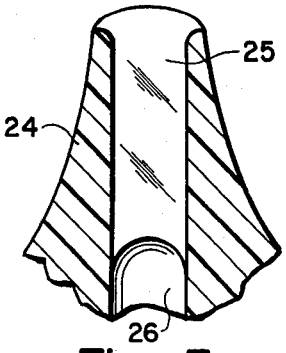
FIG. 3 is a partial sectional view of the one-way check valve structure of FIG. 2 taken along section line 3—3.

The sectional view of FIG. 3 more clearly illustrates the sealing surfaces of preferred one-way check valve 25 defined in valve insert 24. Outlet channel 26, an open channel, terminates adjacent normally sealed one-way check valve 25 which, in the sectional view is illustrated as only one half of flapper valve, but would include a mirror image portion to seal with the illustrated portion. Contents under pressure traveling through outlet channel 26 will cause the flapper valve to distend from its normal configuration of a closed slit to approximate an oval, or under high pressure, a circular opening. However, when pressure upon the contents terminates, the flapper valve resumes its normal slit arrangement. Accordingly, a reverse in pressure tending to induce flow from the exterior of the structure to outlet channel 26 merely causes the external pressure more tightly seal the flapper valve thereby procluding reverse flow. In this manner even air is substantially isolated from the contents of bladder structure 10.

Figure 2:
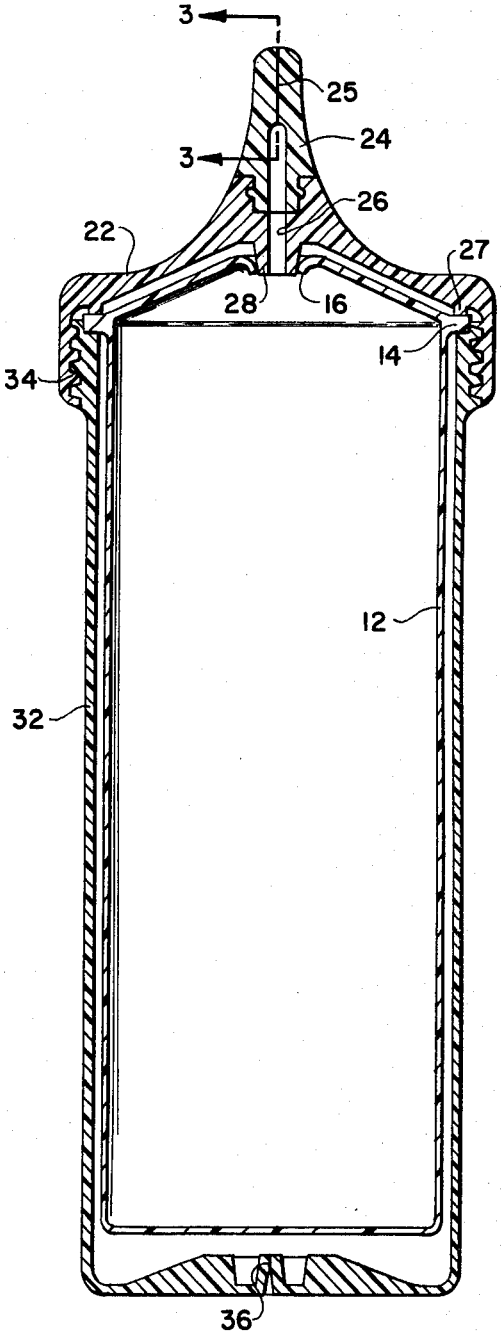
FIG. 2 is a sectional view of the assembled structure illustrated in FIG. 1.
Figure 4:
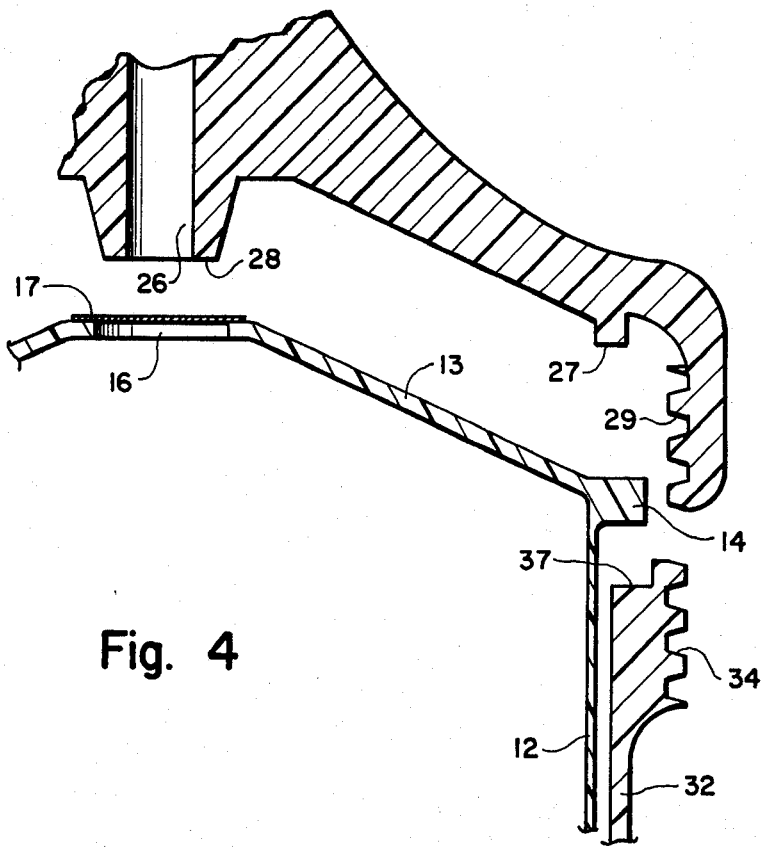
FIG. 4 is an enlarged partial section view illustrating the relationship of the three primary components of the instant invention.

The assembly of and preferred structure of the dispensing apparatus will be more readily understood with reference to FIG. 4, whereat it is shown that perforable seal 17 may be disposed across opening 16, thereby permitting bladder structure 10 to be transported and utilized for storage. However, conical insert 28, defined on the interior central portion of cap portion 20 is adapted to pierce perforable seal 17 to engage and seal the walls defining opening 16 as illustrated in FIG. 2. This is normally accomplished as interior threads 29 of cap portion 20 are engaged with and advanced upon exterior threads 34 of body portion 30. Also, as cap portion 20 is positioned on and secured to body portion 30, annular securing surface 27 defined on cap portion 20 engages annular ridge 14 defined circumferentially around the upper portion of bladder structure 10 and urges annular ridge 14 into engagement with the surface of annular indent 37, defined around the upper interior portion of body portion 30, thereby securely locating and positioning bladder structure 10 between cap portion 20 and body portion 30 with conical insert 28 piercing perforable seal 17 and bearing in a sealing manner against the walls of opening 16 of bladder structure 10. Of course seal 17 could be manually removed prior to positioning cap portions 20 on body portion 30.

Thus when the components of the dispensing structure are assembled as described above, a user may grasp and squeeze a resilient outer container thereby causing the flowable contents of the internal bladder structure to flow through outlet channel and, ultimately, through the first flapper valve 25 to be conveniently and accurately dispensed. When the squeezable container is released, air is permitted to flow through the other one-way flapper valve defined in the outer container to permit the outer container to return to its relaxed shape, while the bladder structure is reduced in volume by an amount corresponding normally to the contents thereof dispensed. Such reversed pressure tightly seals the first flapper valve to protect the contents of the bladder structure.

In summary, the squeezable dispensing structure of the instant invention provides multiple advantages. Flowable contents, such as liquid food items, chemical reagents, etc., may be packaged in economical, light weight and secure bladder structures for storage and/or shipping. When the contents are to be used, the bladder structure may be readily positioned in a reusable outer container, preferably by merely securing together two parts of the outer container whereupon the bladder structure is seized between the two parts and a probe inserted into the bladder. The probe both pierces and seals the bladder. Then, upon squeezing the outer container, the resulting pressure on the bladder structure expels the contents through a first one-way check valve. When pressure is released, the resilient outer container elastically returns to its normal configuration as a result of air being admitted between the resilient outer container and the exterior of the bladder structure by a second one-way check valve. The first one-way check valve automatically seals upon the pressure reversal, thereby maintaining the contents of the bladder structure in a sealed and uncontaminated state. Use of the dispensing structure does not require removal of a cap, etc. The resilient outer container may be made of more expensive decorative material since many of the less costly bladder structures may be used over time with a single resilient outer container.

Various details of the dispensing structure have been illustrated and described only in the preferred configuration. However, other materials than those described, various means of fastening together the two, or more, components of the resilient outer container, other one-way check valves than the preferred flapper valve, and other shapes than cylindrical are clearly workable. Accordingly, the attached claims are intended to cover these and other equivalent embodiments of the invention which may occur to those skilled in the art.

What is claimed is:

1. Apparatus for dispensing flowable substances, the apparatus comprising:

a substantially closed pliable bladder structure adapted to contain a flowable substance, the bladder structure including an annular ridge defined around the perimeter thereof adjacent one end of the bladder structure and an opening defined in the end of the bladder structure;

a resilient outer container configured to enclose the bladder structure, the outer container including a removable cap portion and a bottom portion, the cap portion having defined therethrough a dispensing channel having a conical projection defined concentric with the inlet terminus of the dispensing channel, the dispensing channel communicating at one end with the exterior of the outer container and at the other end with the interior of the bladder structure in a sealing relationship with the conical projection engaging and sealing against the opening defined in the bladder structure, the body portion and cap portion further defining at the interface therebetween opposed surfaces adapted to engage opposite sides of the projecting annular ridge therebetween when the cap portion is secured to the body portion of the resilient container;

a first one-way check valve positioned in the channel and oriented to permit flow from the bladder structure; and a second one-way check valve positioned in the outer surface of the outer container and positioned to permit flow from the exterior of the resilient container to the volume defined between the bladder structure and the resilient container.

2. Dispensing apparatus as set forth in claim 1 in which at least the dispensing channel check valve is a flapper valve.

3. Apparatus for containing and dispensing a flowable substance, the apparatus comprising:

a cylindrical resilient body portion open at one end and closed at the other end with external threads defined adjacent the open end thereof;

a cap portion having internal threads defined thereon complementary to the external threads of the body portion, the cap portion including a dispensing channel having an inlet opening and an outlet opening defined therethrough, a first one-way check valve oriented to permit flow to the external portion of the cap portion positioned in the dispensing channel and a conical projection defined concentric with the inlet terminus of the dispensing channel;

a substantially closed bladder structure of the pliable material having an opening defined therein, the bladder structure being adapted to be received in the body portion and secured therein between the body portion and the cap portion with the opening defined in the end of the bladder structure engaging and sealing against the conical projection of the dispensing channel defined in the cap portion with the conical member communicating with the interior of the bladder structure through the opening defined therein; and a second one-way valve positioned through the resilient body portion and oriented to permit flow into the body portion.

4. Dispensing apparatus as set forth in claim 3 in which at least the dispensing channel valve is a flapper valve.

5. A method for inserting a flowable substance in a squeeze container for dispensing therefrom, the method comprising:

securing a bladder structure with a sealed opening defined therein and containing a flowable substance within a resilient outer container;

placing a removable cap on the resilient outer container, the cap having a concentrically positioned member thereon and communicating with the inlet of a dispensing channel defined therethrough;

piercing the sealed opening defined in the bladder structure with the conical member and sealing against the bladder structure opening with the conical member as the removable cap is placed on the resilient container to operably connect the dispensing channel with the interior of the bladder structure;

distending the resilient outer container and bladder structure to reduce the volume of the bladder structure and generate an increased pressure greater than ambient pressure on the flowable substance in the bladder structure;

conducting the flowable substance under pressure through the opening in the bladder structure and into the dispensing channel at the conical projection cap;

opening a first one-way check valve in the dispensing channel to permit the flowable substance to flow to the exterior of the dispensing apparatus;

releasing the resilient container to allow the interior pressure to be reduced below ambient pressure;

closing the first one-way check valve as a result of the reverse pressure; and opening a second one-way check valve communicating between the exterior of the resilient container and the volume defined between the interior of the resilient container and the bladder structure to permit air to flow into such defined volume to substantially equalize the interior pressure of the resilient container and the ambient pressure as the container returns to its unstressed configuration.

* * * * *